United States Patent [19]

Herron

[11] Patent Number: 4,570,646

[45] Date of Patent: Feb. 18, 1986

[54] METHOD AND APPARATUS FOR SMOKING

[76] Inventor: B. Keith Herron, 504 Hamlin Park, Chapel Hill, N.C. 27514

[21] Appl. No.: 588,060

[22] Filed: Mar. 9, 1984

[51] Int. Cl.[4] ..... A24F 3/00; A24F 13/00

[52] U.S. Cl. ..... 131/185; 131/174; 131/175; 131/198.1; 131/198 Z; 131/215.1

[58] Field of Search ..... 131/176, 330, 329, 174, 131/215 R, 175, 198 R, 185, 198 A

[56] References Cited

U.S. PATENT DOCUMENTS

| | | | |
|---|---|---|---|
| 2,335,786 | 11/1943 | Mullica | 131/176 |
| 2,974,669 | 3/1961 | Ellis | 131/330 |
| 4,164,230 | 8/1979 | Pearlman | 131/330 |
| 4,369,798 | 1/1983 | Jackson | 131/330 |
| 4,436,100 | 3/1984 | Green | 131/330 |

*Primary Examiner*—V. Millin

*Attorney, Agent, or Firm*—Mills and Coats

[57] ABSTRACT

The present invention comprises a method and apparatus for smoking. The smoking apparatus is specifically designed for use by smokers in smoking cigarettes. Moreover, the smoking apparatus may be referred to as a generally closed smoking system because smoke normally produced about the burning end of the cigarette is confined, and further a smoke receiving chamber is provided for receiving exhaled smoke from the smoker.

20 Claims, 5 Drawing Figures

METHOD AND APPARATUS FOR SMOKING

FIELD OF INVENTION

The present invention relates to tobacco smoking apparatuses, and more particularly to generally closed tobacco smoking systems specifically designed for limiting and controlling the rate of burning of tobacco material contained within a smoking apparatus.

BACKGROUND OF INVENTION

For some years there has been a move for limiting and restricting smoking in certain public areas. For example, there has long existed smoking and non-smoking areas on commercial airlines. Moreover, the Civil Aeronautics Board is now considering totally banning smoking on short flights. Smoking restrictions such as those presently found on commercial airlines exist in other public areas as well. Many State and local governments have considered and are presently considering legislation aimed at restricting smoking in certain public areas, especially public areas where individuals find themselves in close quarters. Thus in the future it is likely that such restrictions on smoking will have a substantial effect on smoking and the right and ability to smoke in public areas.

While restricting smoking in public areas may be effective, it is interesting to consider that very little effort has been made in the area of designing a smoking apparatus or a smoking system that will enable an individual to smoke tobacco material or a cigarette and not bother individuals in and around the individual smoking. In this regard, what is being alluded to is a smoking apparatus that can be deemed to be a closed or generally closed smoking system. Such a closed smoking system entails a smoking apparatus wherein the smoking material or cigarette contained within a structure and during the smoking process the resulting smoke from the cigarette and/or the individual smoking is somehow confined.

There has been some very limited efforts at designing such a generally closed smoking system. For example, see the disclosures found in U. S. Pat. Nos. 4,198,992; 4,211,244; 4,198,992 and 1,792,279. However, these smoking devices are not truly totally closed smoking systems. In addition they have tended to be large, bulky and hard to handle. In addition besides being large and bulky, such smoking devices of the prior art have tended to be complicated and hence expensive.

SUMMARY AND OBJECTS OF INVENTION

The present invention presents a smoking apparatus that is designed to overcome some of the drawbacks associated with such smoking devices of the prior art and which is designed to generally confine a substantial portion of the smoke resulting from a burning cigarette so as to at least prevent that smoke from intruding into the space of others in the vicinity of the smoker. In addition the smoking apparatus of the present invention is provided with a very unique and novel feature that actually controls the rate of burning of the tobacco material such that the tobacco material is only burned on demand and the smoker receives the full benefit of all of the tobacco material burned.

The present smoking apparatus includes a tobacco holding structure specifically designed to receive a cigarette. The tobacco holding structure includes a normally closed chamber that encloses the tobacco material which includes a burning coil that in operation normally engages the burning end of the cigarette. The coil is movably mounted within the tobacco holding structure and spring biased to move against the burning end of the tobacco material during the smoking process. The normally closed chamber is specifically provided with means for varying the volume of the chamber during the smoking process. In particular as the smoking material is burned, one wall or end of the normally closed chamber moves towards the burning end or portion of the tobacco material so as to generally define a constant volume of space outside of the area occupied by the tobacco material itself. This constant volume enables the burhing rate of tobacco material to be limited and controlled inasmuch as the tobacco material cannot be burned after the oxygen contained within the air found within the chamber has been depleted.

It is, therefore, an object of the present invention to provide a smoking apparatus that tends to enclose the tobacco material being smoked and which generally minimizes smoke resulting from the tobacco material from moving in and around other individuals that may be in the vicinity of the smoker.

A further object of the present invention is to provide a very efficient smoking apparatus that automatically controls the burning rate of the tobacco material contained during the smoking process thereby preventing a substantial portion of the tobacco material from being wasted.

A further object of the present invention resides in the provision of a smoking apparatus having means for automatically burning tobacco material and wherein the means for burning the tobacco material is movably mounted within the smoking apparatus for continuous movement during the smoking process such that the same can be held adjacent the tobacco material to be burned at all times during the process.

Still a further object of the present invention resides in the provision of a smoking apparatus of the character referred to above wherein the burning means is in the form of a coil and wherein said coil is movably mounted within the smoking apparatus and spring biased to move towards the tobacco material during the smoking process.

Still a further object of the present invention is to provide a smoking apparatus of the character referred to above that includes an energy source in the form of an electric battery for powering said coil.

Another object of the present invention resides in the provision of a smoking apparatus and a smoking system which includes a smoke receiving structure that is designed to accept smoke exhaled by a smoker and to contain such smoke and even filter the same before being exhausted from the smoke receiving chamber.

A further object of the present invention is to provide a smoking apparatus of the character referred to above that is relatively simple, lightweight, easy to use, and easy to handle and carry.

It is also an object of the present invention to provide a smoking apparatus that is easy to load.

Another object of the present invention resides in the provision of a smoking apparatus of the character referred to above wherein the flame or burning end of the tobacco material within the smoking apparatus of the present invention is safely isolated from the atmosphere and from the view of others.

A further object of the present invention resides in the provision of a smoking apparatus of the character referred to above that is constructed of fireproof material so as to prevent accidental burning and dangerous fires.

A further object of the present invention is to provide a smoking apparatus wherein the rate of burning of tobacco material within the smoking apparatus is inherently and automatically controlled by the smoking action of the smoker.

Other objects and advantages of the present invention will become apparent from a study of the following description and the accompanying drawings which are merely illustrative of such invention.

SMOKING APPARATUS AND GENERALLY CLOSED SMOKING SYSTEM

With further reference to the drawings, the smoking apparatus of the present invention is shown therein and indicated generally by the numeral 10.

Figure 1:
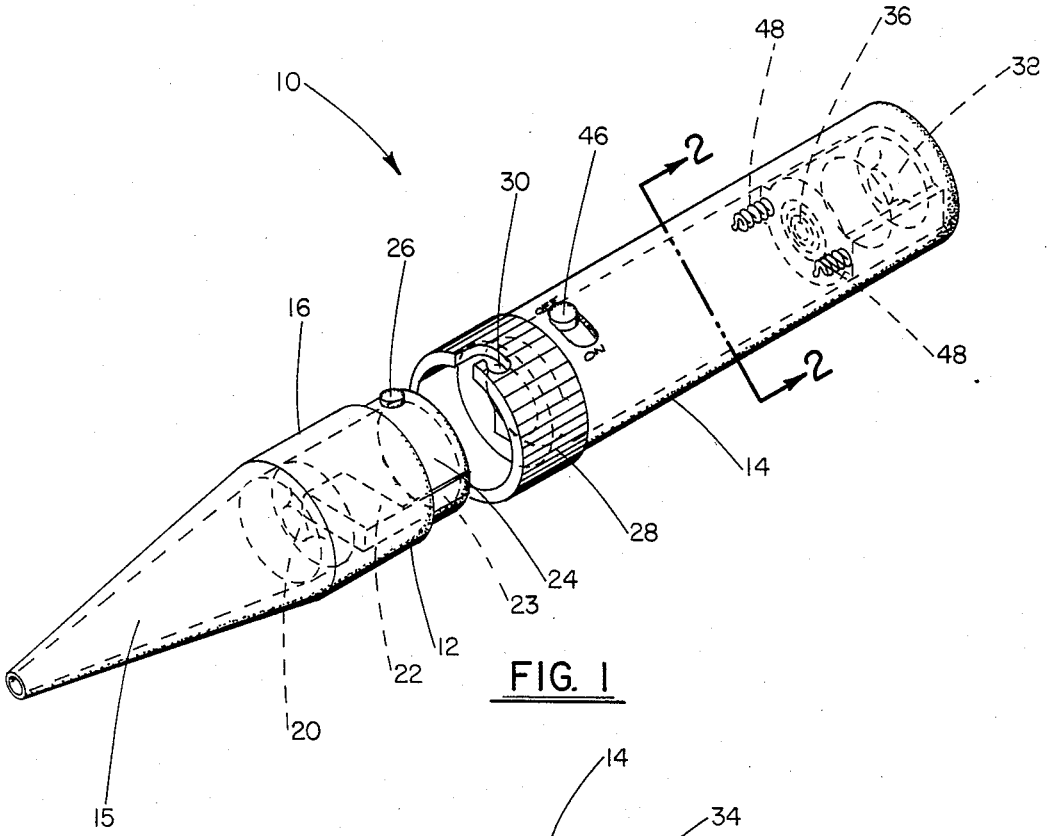
FIG. 1 is a perspective view of the smoking apparatus of the present invention, particularly illustrating the two sections thereof separated from each other.

Smoking apparatus 10 comprises a tobacco material holding structure that is in the form of an elongated cylinder type structure that is particularly designed to receive and hold a cigarette therein. As illustrated in FIG. 1, the tobacco material holding structure includes a pair of separable sections 12 and 14. As will be more fully understood from subsequent portions of this disclosure, separable sections 12 and 14 are designed to be separated in order that a cigarette or other form of smoking material can be appropriately loaded and contained therein. After this, sections 12 and 14 can be joined together in an appropriate fashion in order that the smoking process can be commenced.

Viewing smoking apparatus 10 in more detail and with particular attention being directed to section 12 thereof, it is seen that section 12 includes a mouth piece 15 that can be readily interchanged. Section 12 is in the general form of a cylinder and as such includes a forward cylindrical wall 16 that defines an inner cavity 18 therein. In addition, provided between mouthpiece 15 and cavity 18 is a one-way check valve assembly 20. Check valve 20 is designed such that air and smoke can flow from cavity 18 to and through mouthpiece 15, but not vice versa.

Also provided about section 12 is a battery compartment for receiving and holding an electric battery 22. A conductor 23 operatively extends from battery 22. The significance of electric battery 22 will be more fully understood and appreciated from subsequent portions of this disclosure.

Extending outwardly from cavity 18 about what is referred to as the outer end of section 12 is a joining collar 24. Joining collar 24 includes an upwardly extending locking detent 26 that extends upwardly about the outer portion thereof.

Now turning to the other section, section 14, it is seen that the same includes an inner end locking collar 28 that is provided with a detent receiving notch 30 formed therein. It is appreciated that when sections 12 and 14 are joined that joining collar 24 of section 12 extends inside locking collar 28 of second section 14 and that the two sections are locked together by appropriately twisting the respective sections 12 and 14 such that locking detent 26 is securely received and confined within detent receiving notch 30.

As seen in the drawings, section 14 is of an elongated cylindrical design and includes a substantial hollow cylindrical opening extending through portions thereof.

Figure 3:
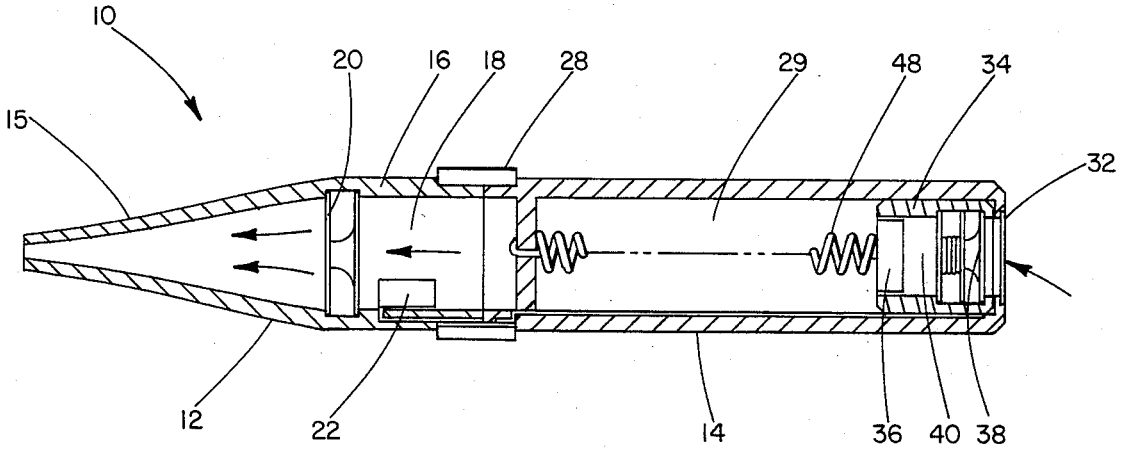
FIG. 3 is an elongated sectional view of the smoking apparatus of the present invention.

Secured within the outer remote end of section 14 is a stationary one-way check valve assembly 32. As illustrated in FIG. 3, check valve assembly 32 will only permit air to move right to left through the check valve and not vice versa.

As further seen in FIG. 3, there is formed an open cavity 29 within the wall structure of the elongated cylinder section 14.

Figure 2:
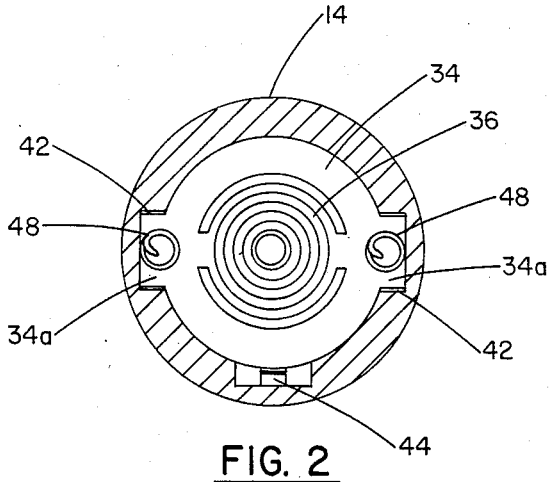
FIG. 2 is a cross sectional view of the smoking apparatus of the present invention taken along the line 2—2 in FIG. 1.

Movably mounted within cavity 29 is a sliding slide cylinder 34. Slide cylinder 34 includes a pair of opposite guide rails **34*a* that are confined within a pair of slots 42 formed in the inside wall structure of section 14. This is particularly illustrated in FIG. 2**.

Secured about the lead or inner side of slide cylinder 34 is an electrical coil 36.

Spaced outwardly from coil 36 and secured within slide cylinder 34 is another one-way check valve assembly 38. Check valve assembly 38 is oriented in the same manner as the other check valves found in the smoking apparatus 10. In particular one-way check valve assembly 38 is operative to direct air right to left through the smoking apparatus 10, as viewed in FIG. 3. Between coil 36 and one-way check valve assembly 38, there is defined an air space 40.

As pointed out above, slide cylinder 34 is movable fore-and-aftly within cavity 29 of second section 14. To bias slide cylinder 34 towards section 12, there is provided a pair of coil springs 48, the coil springs being operatively connected at one end to slide cylinder 34 with the other end of the springs 48 being anchored to the wall structure of section 14. Therefore, it is appreciated that the entire slide cylinder 34 and the coil 36 carried thereby is generally biased to move from right to left within cavity 29.

In order to transfer electrical energy through coil 36, there is provided an elongated power rail conductor 44 that is formed within the side wall structure of section 14. Power rail conductor 44 through appropriate conductors such as a brush is operative to direct electrical current to coil 36. An on-off switch 46 is formed within the outer wall structure of section 14 and is operatively interconnected between battery 22 and the rail conductor 44. In the "on" position, on-off switch 46 is operative to transfer electrical current from battery 22 to coil 36.

To limit the right to left movement (as viewed in FIG. 3) of slide cylinder 34, there is provided at a selected location within cavity 29 a stop that effectively stops slide cylinder 34. These stops would preferably be provided within the formed slots 42 formed within the inner wall structure of section 14.

Figure 5:
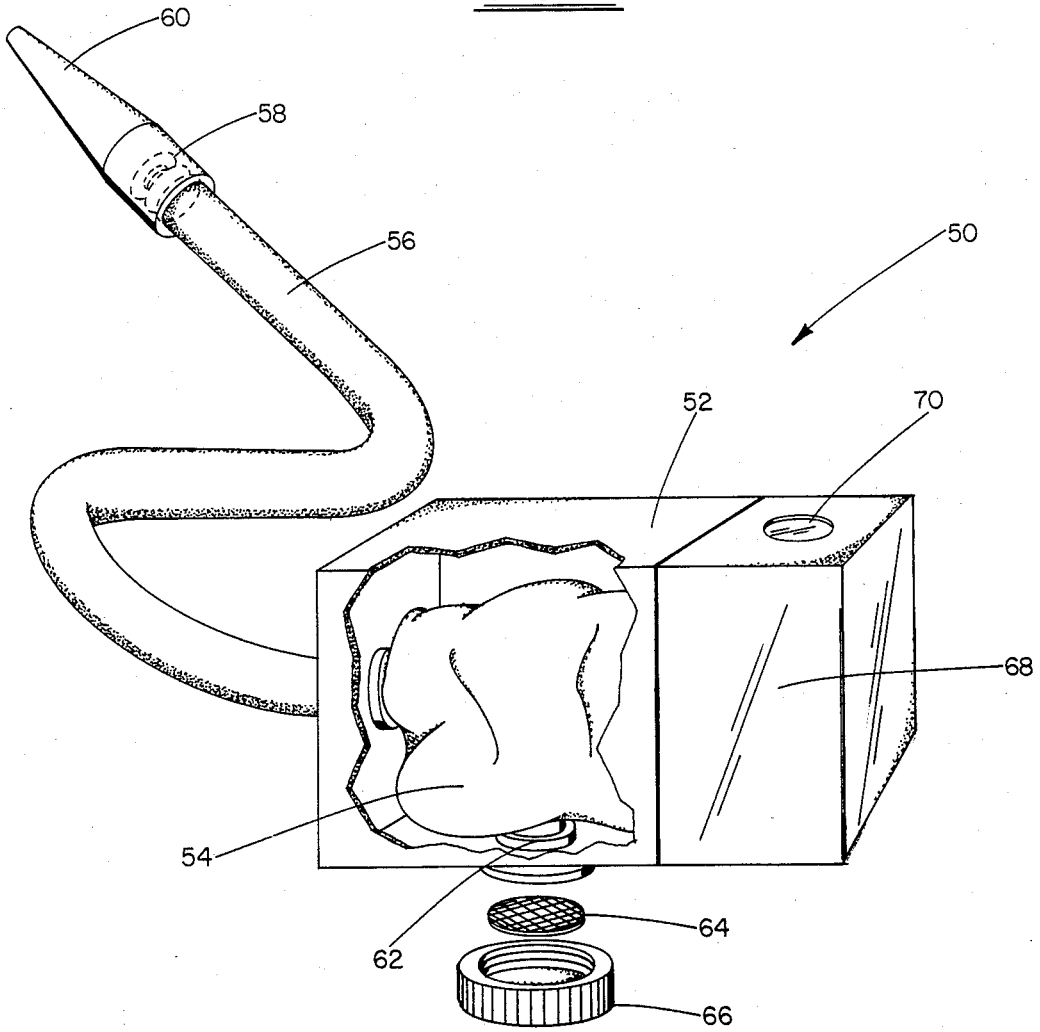
FIG. 5 is a perspective view of a smoke receiving chamber and associated structure utilized to receive and contain smoke exhaled by a smoker.

Turning to FIG. 5, there is shown therein an exhaled smoke receiver, indicated generally by the numeral 50. This device forms a part of the closed smoking system of the present invention and is designed to receive smoke that is exhaled from the smoker's lungs.

Viewing smoke receiver 50, it is seen that the same comprises a container structure 52 that includes a pliable bag 54 contained therein. Pliable bag 54 includes an inlet tube 56 communicatively connected thereto. Inlet tube 56 includes a mouthpiece 60 and interposed between the mouthpiece 60 and the pliable bag 54 is a one-way check valve 58. One-way check valve 58 is operative to only allow smoke to move from mouthpiece 60 through check valve 58 and into pliable bag 54 and not vice versa.

Pliable bag 54 includes an outlet 62. In the present disclosure there is provided an interchangeable filter 64 that is secured adjacent outlet 62 by a screw-on filter retainer 66.

Therefore, it is appreciated that smoke exhaled into pliable bag 54 can remain therein until a predetermined volume of air is contained. After the pliable bag has received that predetermined volume of air, it is appreciated that as additional air is exhaled and directed into the pliable bag 54 that ai within the pliable bag 54 is caused to be exhausted through outlet 62. The presence of filter 64 acts to clean the smoke being directed from the pliable bag.

Smoke receiver 50 further includes a butt box 68 for receiving discarded cigarette butts. Butt box 68 includes an opening 70 formed therein through which the cigarette butts are dropped.

Figure 4:
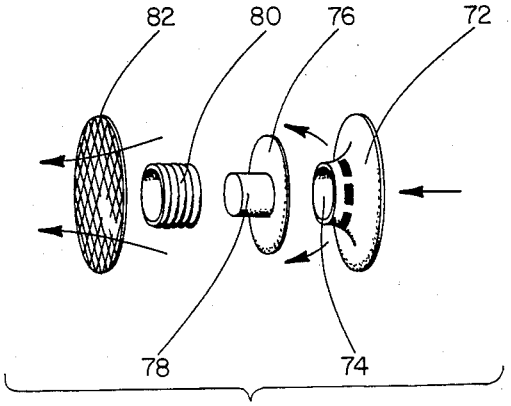
FIG. 4 is an exploded perspective view of a one-way check valve of the type that may be utilized within the smoking apparatus of the present invention.

In the foregoing discussion, it is appreciated that the smoking apparatus 10 and generally closed smoking system discussed herein is designed such that the one-way check valves are utilized. I should be pointed out at this time that the smoking apparatus and generally closed smoking system of the present invention may utilize various types of one-way check valves that are presently known or commercially available. However, for the purposes of providing a complete disclosure and for illustrating a possible one-way check valve design, one is referred to the disclosure found in FIG. 4. Therein is shown a one-way check valve in an exploded view that comprises an inlet 72 that includes an opening 74 formed therein. As viewed in FIG. 4, to the left of inlet 72, there is provided a valve member 76 that is totally impervious to the flow of air and which includes a closed nose 78. A coil spring 80 is disposed around nose 78 and is further interposed between a screen or perforated back 82. In a normally closed position, spring 80 acts to push valve member 76 closely adjacent inlet 72 such that opening 74 is completely blocked. In this closed position, air cannot move in either direction through the one-way check valve assembly. The one-way check valve assembly illustrated in FIG. 4 is designed to allow the movement of air from right to left. To achieve this requires that valve member 76 be moved to the left against the force of spring 80. To achieve this in the smoking apparatus of the present invention, this is accomplished by the smoker creating a vacuum on the left side of valve member 76 by, for example, attempting to induce air through the smoking apparatus 10 referred to above and shown in FIGS. 1 through 3. It is appreciated that once the smoker releases the vacuum by discontinuing to draw on the mouthpiece 10, for example, the force of the spring 80 will drive valve member 76 to a closed position where the valve member 76 effectively closes opening 74 within inlet 72.

In use the smoking apparatus 10 is first broken apart by separating section 12 from section 14. To smoke a cigarette therein, the filter end of the cigarette is inserted within cavity 18 of section 12. The filter end would abut against the battery compartment or a stop or screen which could be placed just forward of battery 22. Then section 14 is capped over the burning end of the cigarette opposite the filter end. It is appreciated that the burning end of the cigarette will then engage coil 36 which will normally be disposed to the left extreme of its stroke as viewed in FIG. 3. By pulling section 14 towards the filter end of the cigarette, such will cause coil 36 and the slide cylinder 34 thereof to be moved towards the remote or right end of section 14 as viewed in FIG. 3. Section 14 is continuously pulled or moved toward section 12 until they are joined together and the two sections are secured together by inserting locking detent 26 into notch 36.

To begin the smoking operation, the on-off switch 46 is moved to its "on" position. This allows electrical current to move from battery 22 through a conductor 23 provided within section 12. When sections 12 and 14 are secured together, conductor 23 contacts power rail conductor 44 which is operatively connected to coil 36. Therefore, current can flow from battery 22 to coil 36 which because of the action of springs 48 rests adjacent the burning end of the cigarette contained within smoking apparatus 10.

At this point it should be pointed out that the internal cavities 16 and 29 of sections 12 and 14 effectively define a normally closed combustion or burning chamber within smoking apparatus 10. The boundaries of the normally closed burning chamber are defined by the cylindrical walls of sections 12 and 14 along with check valves 20 and 38. It is appreciated that the defined chamber can only receive air through check valve 38. In addition it is seen that when the smoking apparatus 10 is loaded with a cigarette that the only open space within the defined burning chamber is that space referred to by numeral 40 that is found between coil 36 and check valve 38. Therefore, once the on-off switch 46 is actuated to the "on" position, this means that coil 36 will begin to burn the adjacent tobacco material of the cigarette contained therein but the amount of burning will be strictly limited by the amount of oxygen contained within air space 40. Once this oxygen is depleted, then there will be no further burning of the tobacco material within the defined normally closed chamber until fresh air is induced within the area 40.

The design of the smoking apparatus 10 of the present invention is such that the smoker controls the burning rate of the tobacco material held within the burning chamber By the smoker drawing air through the smoking apparatus by creating a vacuum within the burning chamber, additional air is induced through check valves 38 and 20. This induced air must be induced into and through check valve 38 and moved through the smoking apparatus from right to left as viewed in FIG. 3. Therefore, this fresh air will support further combustion and burning of material within the burning chamber.

It is appreciated that this process is continued until the smoker has finished the cigarette or has otherwise decided to stop the smoking process. It should be appreciated that stops placed within slots 42 within second section 14 limit the right to left movement of slide cylinder 34. These stops can be particularly placed to assure that the coil does not reach the filter portion of the cigarette contained within sections 12 and 14.

In addition it is appreciated that throughout the entire smoking process that smoke resulting from the burning end of the cigarette cannot move directly into the surrounding atmosphere through the outer remote end of section 14. One-way check valve 38 prevent this. It is appreciated that smoke can only move from right to left, as viewed in FIG. 3, and through the mouthpiece 15 of section 12. Again because of the nature of the design in this case, smoke can only be induced through the smoking apparatus 10 by a drawing action caused by the smoker.

After the smoking process has been completed, sections 12 and 14 may be uncoupled and the remaining cigarette portion removed therefrom. In addition any ashes contained within the smoking apparatus can be removed. In this same regard, it is appreciated that during the smoking process that the coil 36 because of the spring biasing action afforded by springs 48 can move through the burned ashes such that the coil remains in contact with unburned tobacco material disposed at the outer or burning end of the cigarette during the entire smoking process.

In regards to the present system being a totally closed smoking system, it is appreciated that the smoker may exhale smoke directly into the smoke receiving chamber 50 illustrated in FIG. 5. Once the smoker has drawn smoke into his or her lungs, the smoke may be exhaled through mouthpiece 60. The smoke exhaled passes through one-way check valve 58 and into pliable bag 54 via inlet tube 56. This is continued and smoke accumulates within pliable bag 54. Once a select volume of smoke is contained within pliable bag 54, it is appreciated that any additional smoke that is directed into the same will result in a certain portion of the air and smoke being expelled through outlet 62. As the smoke is expelled through outlet 62, the same is constrained to move through an interchangeable filter 64 which tends to clean the air and smoke.

Also it is appreciated that smoke receiver 50 includes a compartment for receiving used and burned cigarette butts.

From the foregoing specification and discussions, it is appreciated that the present invention presents a real and substantial improvement in the area of smoking devices. Of principal importance is the feature that generally contributes to the present invention involving a generally closed smoking system. That is, the smoking apparatus 10 and smoking system of the present invention generally confines the smoke such that it does not move off into the surrounding atmosphere in the way that smoke does under ordinary situations where the cigarette is totally exposed.

In addition the smoking apparatus of the present invention is designed to control the rate of burning. This makes the entire smoking process more efficient than is found in conventional smoking practices. Beyond that, the smoking apparatus of the present invention is relatively small, easy to handle and carry, easy to use and lightweight. Finally the smoking apparatus and generally closed smoking system of the present invention is designed such that the smoking process can be carried out in a completely safe way and that the risk of resulting fire or any fire or smoke related damage at all is minimized.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A smoking apparatus comprising: .

A. a tobacco holding structure for receiving and holding tobacco material to be smoked including an inlet and an outlet wherein during the smoking process an individual may draw and induce air into and through said inlet, through the tobacco holding structure and the tobacco material therein and out said outlet;

B. means associated with said tobacco holding structure for burning said tobacco material contained therein; and C. means for limiting and controlling the burning rate of the tobacco material contained within said tobacco holding structure, said means for limiting and controlling the rate of burning of the tobacco material including a normally closed chamber having tobacco material of said tobacco holding structure contained therein and wherein said normally closed chamber includes normally closed valve means for opening in response to the individual drawing and inducing air into said tobacco holding structure for enabling fresh air containing oxygen to be induced and drawn into said normally closed chamber during the tobacco burning process, and wherein the burning process is limited by the amount of oxygen within said normally closed chamber at any one time and wherein after the oxygen within said chamber has been depleted the smoking process can only be continued by the individual inducing additional air within said normally closed chamber.

2. The smoking apparatus of claim 1 wherein said burning means is movably mounted within said tobacco holding structure and includes an energy source for powering the same.

3. The smoking apparatus of claim 1 wherein said burning means includes an electrical coil; and means movably mounting said electrical coil within said tobacco holding structure for allowing said electrical coil to continuously move during the smoking process such that said coil may continuously engage unburned tobacco material held within said tobacco holding structure.

4. The smoking apparatus of claim 3 wherein said means movably mounting said coil within said tobacco holding structure includes spring means operatively connected to said coil and anchored within said tobacco holding structure wherein said spring means is positioned with respect to the tobacco material held within said tobacco holding structure such that the coil is continuously biased by said spring means to move toward and against unburned tobacco material held within said tobacco holding structure during the smoking process.

5. The smoking apparatus of claim 4 wherein said burning means further includes an electrical storage battery contained within said tobacco holding structure for energizing said coil.

6. The smoking apparatus of claim 1 wherein said normally closed chamber includes a movable wall and means for moving said wall in response to tobacco material within said tobacco holding structure being burned so as to generally maintain a constant space outside of said tobacco material within said normally closed chamber during the smoking process whereby said generally constant space can be filled with air to support the combustion process but wherein the burning of the tobacco material within said normally closed chamber is limited by that amount of air contained within said chamber until additional air is induced into said normally closed chamber.

7. The smoking apparatus of claim 1 including a smoke receiving chamber for receiving smoke exhaled by an individual utilizing said smoking apparatus, said smoke receiving chamber including an inlet that includes a one-way check valve that allows air and smoke to be directed into said smoke receiving chamber through said inlet but prohibits smoke within said smoke receiving chamber from passing therefrom out said inlet.

8. The smoking apparatus of claim 7 wherein said smoke receiving chamber includes an outlet and wherein said outlet includes a filter operatively associated therewith such that air directed out of said outlet is constrained to move through said filter.

9. The smoking apparatus of claim 8 wherein said filter normally disposed within the outlet of said smoke receiving chamber is interchangeable.

10. The smoking apparatus of claim 1 wherein said tobacco holding structure includes an elongated cigarette holder for holding a cigarette having a first burning end and a second opposite end, said second opposite end being the end normally held in the smoker's mouth wherein said cigarette holder includes a pair of spaced apart one-way check valves that are spaced apart a sufficient distance to allow said cigarette to be positioned and held therebetween by said cigarette holder, and wherein said one-way check valves are particularly oriented for unidirectional air movement through said cigarette holder such that air can only move from said first burning end of said cigarette towards and through said second end and not vice versa, whereby that area between said pair of one-way check valves define said normally closed chamber.

11. The smoking apparatus of claim 10 wherein said burning means includes a coil and means for movably mounting said coil adjacent said first burning end of said cigarette and means for moving said coil through said chamber during the smoking process such that said coil continuously moves toward said second end of said cigarette and is maintained adjacent the burning end of the cigarette during the smoking process.

12. The smoking apparatus of claim 11 wherein one of said check valves that forms a part of said chamber is movably mounted within said smokinq apparatus and includes means associated therewith for moving said one check valve during the smoking process for progressively decreasing the volume of said chamber as the smoking process is carried out.

13. The smoking apparatus of claim 12 wherein said one movable check valve and said coil are secured to a sliding member that is movably mounted for fore-and-aft movement within said chamber; and wherein there is provided a generally constant space and volume between said coil and said one movable check valve for limiting and controlling the burning rate of tobacco material during the smoking process.

14. The smoking apparatus of claim 13 wherein said one-way movable check valve is oriented such that air can only move through said one-way check valve towards said coil and not vice versa.

15. A smoking apparatus comprising:

A. a cigarette holding structure for receiving and holding a cigarette having a first burning end and a second end opposite said burning end;

B. said cigarette holding structure including an elongated burning chamber for receiving said cigarette;

C. said burning chamber including a pair of spaced apart one-way check valves;

D. said pair of spaced apart one-way check valves including a first check valve disposed adjacent said burning of said cigarette with a second check valve disposed adjacent the second end of said cigarette;

E. said check valves being selectively oriented and including directional control means for allowing air and/or smoke to move through said first check valve means, through said burning chamber and out thereof through said second check valve means and wherein said check valve means and said directional control means prohibits air or smoke from moving into said chamber through said second check valve means and out of said chamber through said first check valve means;

F. coil means movably mounted between said first check valve means and said burning end of said cigarette, said coil means including associated power means for energizing the same in order that said coil means may burn tobacco material about the burning end of the cigarette;

G. means for movably mounting said coil and means for moving said coil towards said second end of the cigarette during the smoking process such that said coil is maintained generally adjacent unburned tobacco material about the burning end of the cigarette during the smoking process; and H. means for movably mounting said first check valve means and means for moving said first check valve means towards said second end of the cigarette during the smoking process for generally maintaining a constant space and volume between said coil and said first check valve means so as to limit and control the amount of oxygen within the burning chamber at any one time during the smoking process and consequently acting to limit and control the burning rate of the cigarette.

16. The smoking apparatus of claim 15 wherein said cigarette holding structure includes a pair of separable sections that includes means for axially connecting the same together and wherein when connected together said burning chamber is defined interiorly within said pair of sections.

17. The smoking apparatus of claim 16 wherein said means for movably mounting said coil and said first check valve means includes a sliding member movably contained within said burning chamber; and wherein said means for moving said coil and said first check valve means includes spring means operatively connected to said sliding member and further connected to said smoking apparatus for biasing said sliding member and said coil and first check valve means thereof towards said second check valve means.

18. The smoking apparatus of claim 17 wherein there is provided an associated smoke receiving device for receiving smoke exhaled by a smoker utilizing said smoking apparatus.

19. A method of smoking tobacco material wherein smoke produced about the burning end of a cigarette is confined and the rate of burning the tobacco material of the cigarette is limited and controlled, said method comprising the steps of:

A. placing a cigarette having a first burning end and a second end opposite said burning end within a tobacco material burning chamber;

B. burning said burning end of said cigarette with a burner;

C. moving said burner towards said second end of the cigarette during the smoking process and maintaining said burner adjacent said burning end of said cigarette during the smoking process;

D. controlling the flow of air and smoke through said burning chamber by providing only uni-directional air and smoke flow through said burning chamber;

E. said step of controlling the flow of air through said chamber including the step of constraining air to move into said chamber adjacent said burning end and then to move through the cigarette towards said second end thereof and to exit said burning chamber through an end thereof adjacent said second end of the cigarette;

F. controlling the burning rate of the tobacco material contained within said burning chamber;

G. said step of controlling said burning rate including the step of forming an air and oxygen chamber adjacent said burning end of said cigarette and maintaining the volume of said air and oxygen chamber generally constant throughout the smoking process such that at any one time during the smoking process said tobacco material within said burning chamber may only be burned to the extent that the same can be supported by the amount of oxygen contained within said air and oxygen chamber without fresh air and oxygen being induced into said air and oxygen chamber.

20. The method of smoking as recited in claim 19 wherein the step of controlling the rate of burning of tobacco material includes the step of progressively decreasing the volume of said burning chamber during the smoking process by effectively moving a wall structure thereof.

* * * * *